US008109657B2

(12) United States Patent
Huang et al.

(10) Patent No.: US 8,109,657 B2
(45) Date of Patent: Feb. 7, 2012

(54) LED LAMP

(75) Inventors: Xing-Gui Huang, Shenzhen (CN); Chin-Chung Chen, Taipei Hsien (TW); Xiu-Yi Zhang, Shenzhen (CN)

(73) Assignees: Fu Zhun Precision Industry (Shen Zhen) Co., Ltd., Shenzhen, Guangdong Province (CN); Foxconn Technology Co., Ltd., Tu-Cheng, New Taipei (TW)

( * ) Notice: Subject to any disclaimer, the term of this patent is extended or adjusted under 35 U.S.C. 154(b) by 9 days.

(21) Appl. No.: 12/790,861

(22) Filed: May 31, 2010

(65) Prior Publication Data

US 2011/0188255 A1 Aug. 4, 2011

(30) Foreign Application Priority Data

Feb. 3, 2010 (CN) ..... 2010 1 0301167

(51) Int. Cl.
*F21V 29/00* (2006.01)

(52) U.S. Cl. .... 362/294; 362/373; 362/800; 362/249.02

(58) Field of Classification Search ..... 362/249.02, 362/249.11, 800, 373, 294
See application file for complete search history.

(56) References Cited

U.S. PATENT DOCUMENTS

| | | | | |
|---|---|---|---|---|
| 7,588,359 | B2 * | 9/2009 | Coushaine et al. | 362/555 |
| 7,626,213 | B2 * | 12/2009 | Lin | 257/99 |
| 7,670,029 | B1 * | 3/2010 | Luo et al. | 362/294 |
| 7,753,560 | B2 * | 7/2010 | Xu et al. | 362/294 |
| 7,883,246 | B2 * | 2/2011 | Blincoe et al. | 362/373 |
| 2011/0063849 | A1 * | 3/2011 | Alexander et al. | 362/294 |

* cited by examiner

*Primary Examiner* — Anabel Ton
(74) *Attorney, Agent, or Firm* — Altis Law Group, Inc.

(57) ABSTRACT

An LED lamp includes a heat sink including a base and a plurality of fins extending from the base, an LED module mounted on a bottom face of the base, an envelope covering the LED module, and a lamp housing defining a cavity. An annular receiving groove is recessed from the bottom face of the base. The LED module is attached on the bottom face of the base and surrounded by the receiving groove. The envelope includes a recessed body and an engaging flange around the recessed body. The heat sink, the LED module and the envelope are received in the cavity. The fins of the heat sink extend outwardly through the lamp housing and are exposed in an outer environment. A gasket is received in the receiving groove and tightly sandwiched between the base and the flange.

18 Claims, 4 Drawing Sheets

LED LAMP

BACKGROUND

1. Technical Field

The disclosure relates to illumination devices and, particularly, to an LED (light-emitting diode) lamp having a good waterproof performance 2. Description of Related Art LEDs are well known solid state light sources, in which current flows in a forward direction through a junction of two different semiconductors. Electrons and cavities combine at the junction to generate light. LEDs provide advantages of resistance to shock and practically limitless lifetime under specific conditions. When deployed in a lamp, LEDs offer a cost-effective yet high quality alternative to incandescent and fluorescent light fixtures.

When the LED lamp is used outdoors for illumination, dust and moisture may enter the LED lamp, causing current leakage or short circuit, or contamination of the LEDs.

What is needed, therefore, is an LED lamp which can overcome the described limitations.

BRIEF DESCRIPTION OF THE DRAWINGS

Many aspects of the present apparatus can be better understood with reference to the following drawings. The components in the drawings are not necessarily drawn to scale, the emphasis instead being placed upon clearly illustrating the principles of the present apparatus. Moreover, in the drawings, like reference numerals designate corresponding parts throughout the several views.

DETAILED DESCRIPTION

Figure 1:
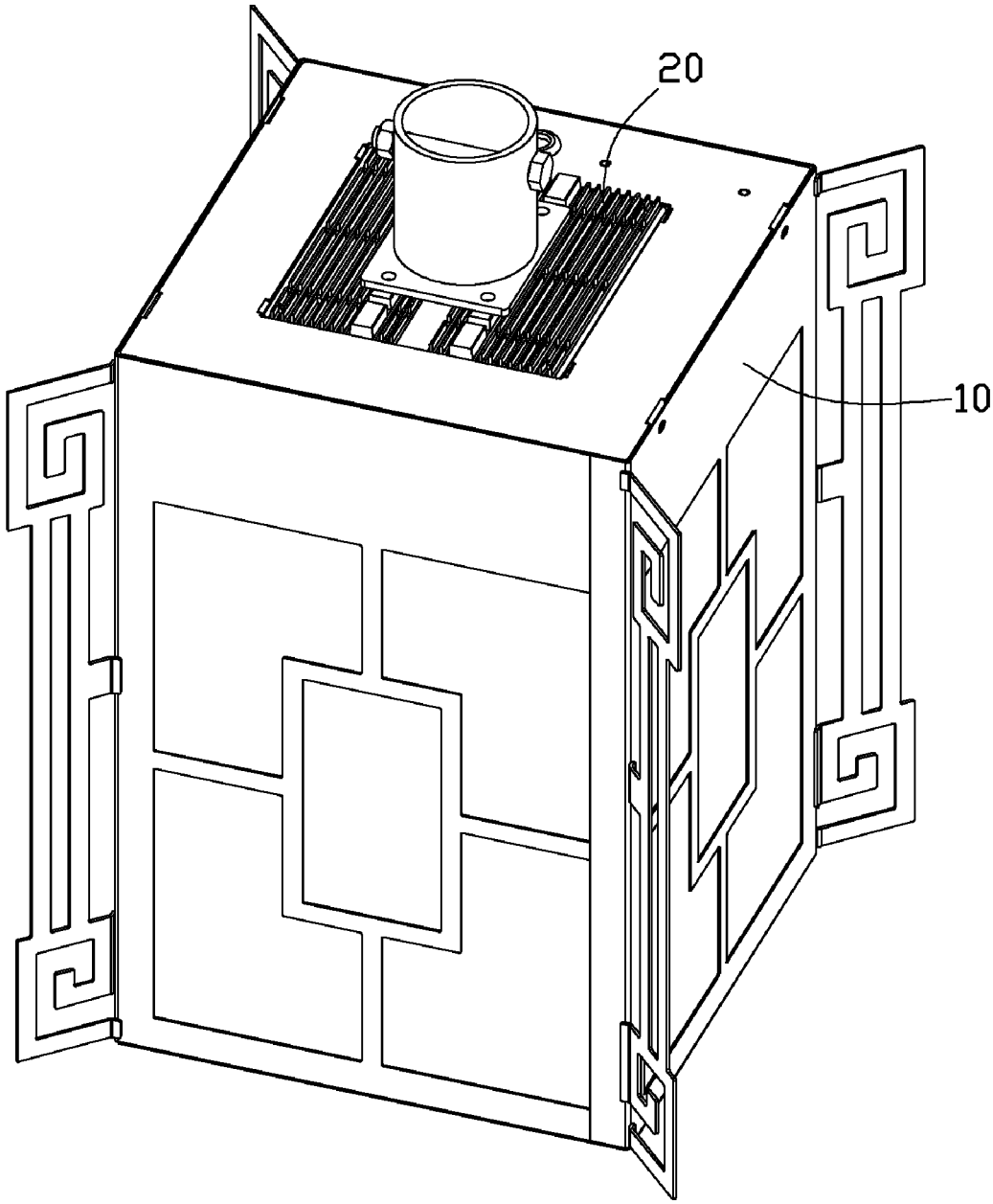
FIG. 1 is an isometric, assembled view of an LED lamp in accordance with an embodiment of the disclosure.
Figure 2:
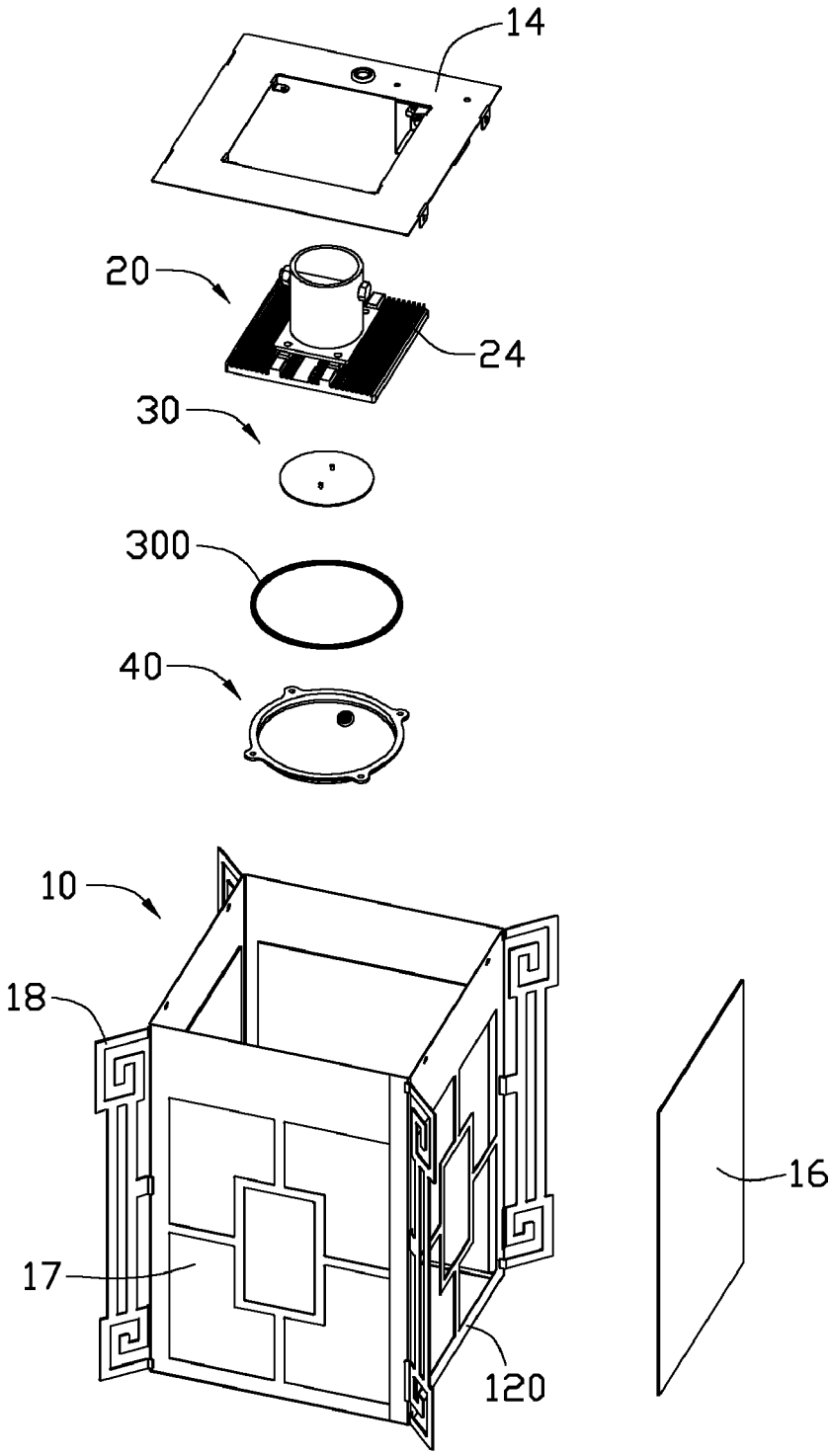
FIG. 2 is an exploded view of the LED lamp of FIG. 1.

Referring to FIGS. 1 and 2, an LED lamp in accordance with an embodiment of the disclosure can be applied outdoors for illumination and has a good waterproof performance. The LED lamp comprises a hollow lamp housing 10, a heat sink 20 received in the lamp housing 10, an LED module 30 mounted on the heat sink 20, and a transparent envelope 40 mounted on the heat sink 20 and correspondingly covering the LED module 30.

Figure 3:
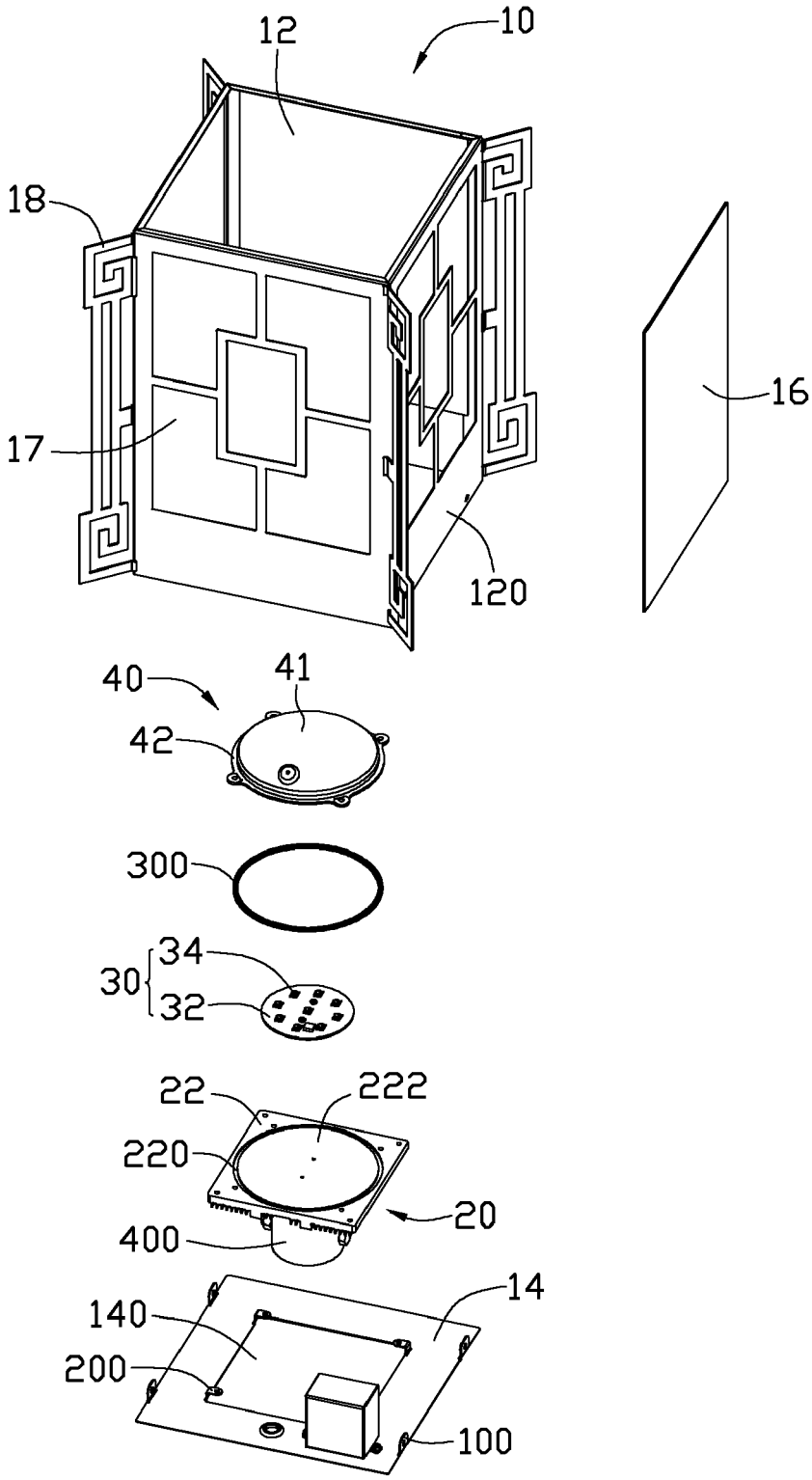
FIG. 3 is an inverted, exploded view of the LED lamp of FIG. 1.
Figure 4:
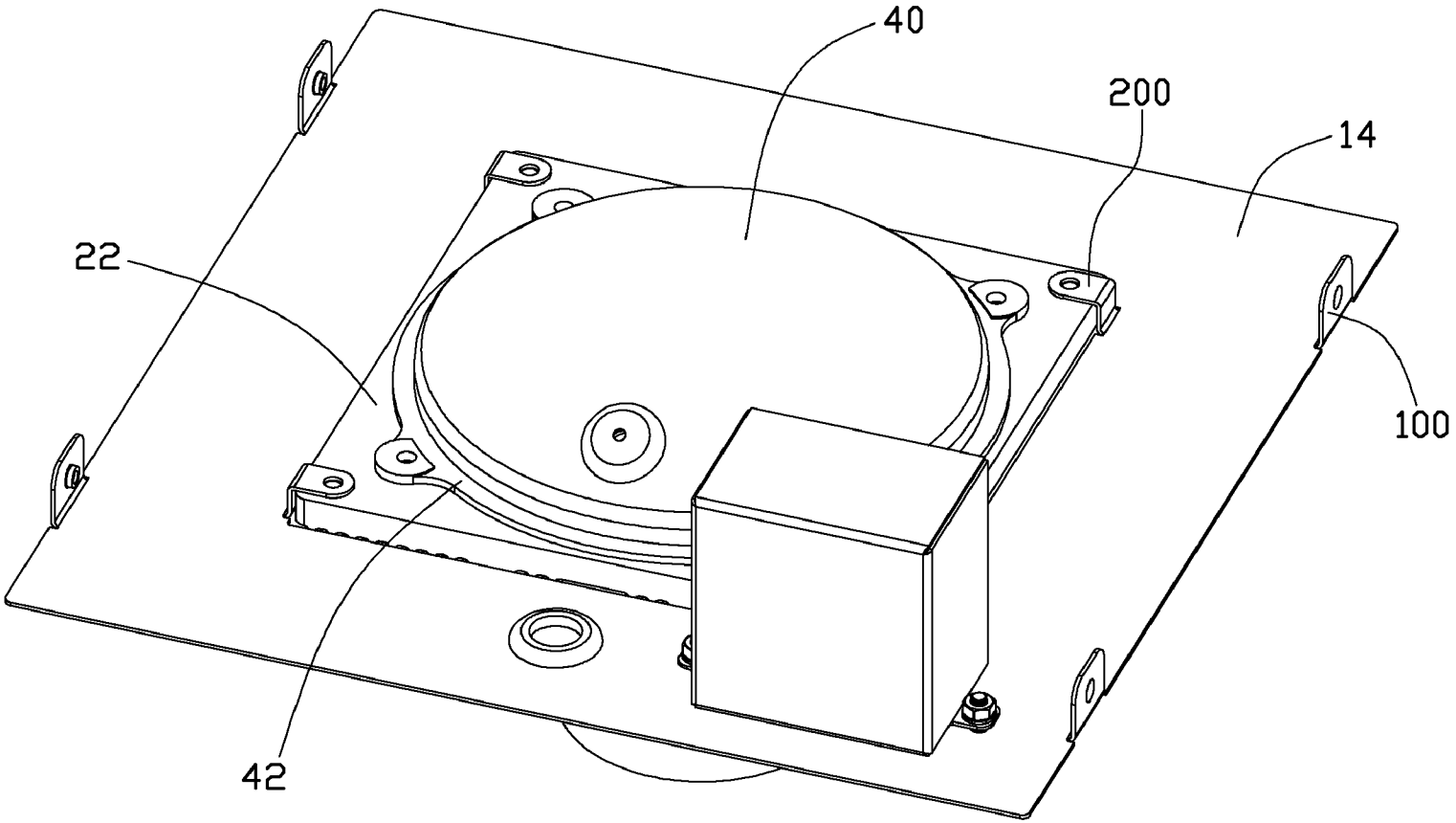
FIG. 4 is an enlarged, inverted view of a combination of a heat sink and a cover plate of the LED lamp of FIG. 1.

Referring to FIGS. 3 and 4 also, the lamp housing 10 has a configuration like a rectangular lantern and defines a cavity 12 inside the lamp housing 10. The lamp housing 10 is cuboid-shaped and comprises four upright lateral plates 120 and a cover plate 14. The four lateral plates 120 are hollowed out. The hollow-out four lateral plates 120 each define a light-emergent window 17, for light emitted by the LED module 30 radiating out of the lamp. Four transparent boards 16 are further provided to the lamp housing 10 and secured to the four lateral plates 120, respectively. The transparent boards 16 correspondingly cover the light-emergent windows 17, respectively. The transparent boards 16 are disposed in the cavity 12 inside the lamp housing 10. Four hollow-out decorated brackets 18 extend outwardly and diagonally from joints of every two adjacent lateral plates 120, respectively. The cover plate 14 defines a rectangular opening 140 at a center thereof.

The cover plate 14 further comprises four spaced first mounting members 100 extending downwardly from a circumference of the cover plate 14. Four screws (not shown) are extended through the four first mounting members 100, and then screwed into the lateral plates 120, for securing the cover plate 14 on the lateral plates 120. The cover plate 14 further comprises four spaced second mounting members 200 extending downwardly from the cover plate 14 around the opening 140. Each of the second mounting members 200 is L-shaped and comprises a first arm (not labeled) extending perpendicularly from the cover plate 14 and a second arm (not labeled) extending perpendicularly from the first arm. The heat sink 20 is fixed on and supported by the second arms of the four second mounting members 200, whereby the heat sink 20 is securely received in the opening 140 of the cover plate 14 and the cavity 12 of the lamp housing 10. Additionally, a driving module (not labeled) is fixed on a bottom face of the cover plate 14.

The heat sink 20 is integrally made of a metal with good heat conductivity such as aluminum, copper or an alloy thereof. The heat sink 20 comprises a rectangular base 22 and a plurality of fins 24 extending outwardly from the base 22. The base 22 is a rectangular plate. An annular receiving groove 220 is defined on a bottom face of the base 22 for correspondingly receiving an annular gasket 300 therein. A circular mounting portion 222 is formed at a central area of the base 22 and surrounded by the receiving groove 220. The LED module 30 is attached on the mounting portion 222 and thermally connects therewith. The base 22 has a size substantially the same as that of the opening 140 of the cover plate 14. When the heat sink 20 is assembled to the lamp housing 10, the base 22 of the heat sink 20 is fittingly fixed on the four second mounting members 200 of the cover plate 14, and the fins 24 are extended through the opening 140 of the cover plate 14 and exposed in an outer environment.

The LED module 30 comprises a circular printed circuit board 32 and a plurality of LEDs 34 mounted on the printed circuit board 32. The printed circuit board 32 is attached on the mounting portion 222 of the heat sink 20. The LEDs 34 are soldered on the printed circuit board 32 and spaced evenly from each other.

The envelope 40 is integrally formed of a transparent or semitransparent material such as glass, resin or plastic. The envelope 40 comprises a recessed body 41 and an engaging flange 42 extending outwardly and horizontally from a periphery of the body 41. The engaging flange 42 of the envelope 40 has a size slightly larger than that of the receiving groove 220 of the heat sink 20, whereby the receiving groove 220 is fittingly covered by the engaging flange 42. When the envelope 40 is assembled to the heat sink 20, the gasket 300 is sandwiched between the engaging flange 42 and the base 22 defining the receiving groove 220, so that the envelope 40 is hermetically connected to the heat sink 20 and a receiving chamber (not labeled) for accommodating the LED module 30 is cooperatively defined between the heat sink 20 and the envelope 40. A plurality of screws (not shown) are used to extend through the engaging flange 42 and threadedly engage in the bottom face of the base 22.

A tubular mounting seat 400 is further provided to the LED lamp, for mounting the LED lamp to a lamp post (not shown) securely mounted at, for example, a roadside. The mounting seat 400 is fixed to the heat sink 20 and located at a top side of the LED lamp to be hung to a lamp pole.

It is to be understood, however, that even though numerous characteristics and advantages of the present embodiments have been set forth in the foregoing description, together with details of the apparatus and function of the embodiments, the disclosure is illustrative only, and changes may be made in detail, especially in matters of shape, size, and arrangement of parts within the principles of the embodiments to the full extent indicated by the broad general meaning of the terms in which the appended claims are expressed.

The invention claimed is:

1. An LED (light emitting diode) lamp comprising:

a heat sink comprising a planar base and a plurality of fins extending from a top face of the base, wherein an annular receiving groove is recessed from a bottom face of the base for receiving a gasket in the receiving groove;

an LED module attached on the bottom face of the base and surrounded by the receiving groove;

an envelope comprising a recessed body and an engaging flange extending outwardly from a periphery of the body, wherein the gasket is sandwiched between the engaging flange and the base defining the receiving groove, and the LED module is received between the recessed body and the base; and a lamp housing defining a cavity therein, wherein the heat sink, the LED module and the envelope are received in the cavity, and the fins of the heat sink extend outwardly through the lamp housing and are exposed in an outer environment;

wherein the lamp housing comprises a plurality of lateral plates and a cover plate fixed on the lateral plates.

2. The LED lamp as claimed in claim 1, wherein the engaging flange of the envelope has a dimension corresponding to that of the receiving groove.

3. The LED lamp as claimed in claim 1, wherein the cover plate defines an opening at a center thereof.

4. The LED lamp as claimed in claim 3, wherein the base has a size substantially the same as that of the opening of the cover plate.

5. The LED lamp as claimed in claim 3, wherein the base of the heat sink is fixed on the cover plate, and the fins extend through the opening of the cover plate to be exposed in the outer environment.

6. The LED lamp as claimed in claim 1, wherein the base of the heat sink cooperates with the envelope to define a receiving chamber for accommodating the LED module.

7. The LED lamp as claimed in claim 1, wherein the lamp housing has a configuration of a lantern.

8. The LED lamp as claimed in claim 1, wherein the lamp housing is hollowed-out and defines a plurality of windows through which light emitted by the LED module radiates out of the lamp.

9. The LED lamp as claimed in claim 8, wherein the lamp housing further comprises a plurality of transparent boards hermetically covering the windows, respectively.

10. The LED lamp as claimed in claim 9, wherein the transparent boards are disposed in the cavity of the lamp housing.

11. The LED lamp as claimed in claim 8, wherein the lamp housing is cuboid-shaped.

12. The LED lamp as claimed in claim 1, wherein the LED module comprises a printed circuit board and a plurality of LEDs evenly mounted on the printed circuit board.

13. The LED lamp as claimed in claim 1, wherein the heat sink is made by one of copper and aluminum.

14. The LED lamp as claimed in claim 1 further comprising a tubular mounting seat for mounting the LED lamp on a lamp pole, wherein the mounting seat is fixed to the heat sink and located at a top side of the LED lamp.

15. An LED (light emitting diode) lamp comprising:

a heat sink comprising a planar base and a plurality of fins extending from a top face of the base, wherein an annular receiving groove is recessed from a bottom face of the base for receiving a gasket in the receiving groove;

an LED module attached on the bottom face of the base and surrounded by the receiving groove;

an envelope comprising a recessed body and an engaging flange extending outwardly from a periphery of the body, wherein the gasket is sandwiched between the engaging flange and the base defining the receiving groove, and the LED module is received between the recessed body and the base; and a lamp housing defining a cavity therein, wherein the heat sink, the LED module and the envelope are received in the cavity, and the fins of the heat sink extend outwardly through the lamp housing and are exposed in an outer environment;

wherein the lamp housing is hollowed-out and defines a plurality of windows through which light emitted by the LED module radiates out of the lamp.

16. The LED lamp as claimed in claim 15, wherein the lamp housing further comprises a plurality of transparent boards hermetically covering the windows, respectively.

17. The LED lamp as claimed in claim 16, wherein the transparent boards are disposed in the cavity of the lamp housing.

18. The LED lamp as claimed in claim 15, wherein the lamp housing is cuboid-shaped.

* * * * *